US006254366B1

(12) United States Patent
Walton et al.

(10) Patent No.: US 6,254,366 B1
(45) Date of Patent: Jul. 3, 2001

(54) REPLACEABLE SEAL HAVING A FRICTION FIT

(75) Inventors: Frank A. Walton, Fort Worth, TX (US); Edward Grout, Cool, CA (US); James E. Williams, Richardson, TX (US)

(73) Assignee: Dosmatic USA, Inc., Carrollton, TX (US)

( * ) Notice: Subject to any disclaimer, the term of this patent is extended or adjusted under 35 U.S.C. 154(b) by 0 days.

(21) Appl. No.: 09/592,957

(22) Filed: Jun. 13, 2000

(51) Int. Cl.[7] ..... F01C 19/06; F01C 19/08

(52) U.S. Cl. ..... 418/114; 418/119; 418/206.6; 277/357; 277/402

(58) Field of Search ..... 418/119, 206.6, 418/114, 147; 277/357, 402, 549, 551, 562

(56) References Cited

U.S. PATENT DOCUMENTS

| | | | | |
|---|---|---|---|---|
| 219,984 | * | 9/1879 | Schneckenburger | 418/119 |
| 1,005,586 | * | 10/1911 | Webb | 418/119 |
| 3,690,791 | * | 9/1972 | Dieter | 418/119 |
| 3,799,710 | * | 3/1974 | Jacobs | 418/147 |

* cited by examiner

*Primary Examiner*—John J. Vrablik
(74) *Attorney, Agent, or Firm*—Gregory M. Luck; Sankey & Luck, L.L.P.

(57) ABSTRACT

A replaceable seal for a rotor in a rotary fluid machine has a unitary body with integrally formed longitudinal and radial seal portions secured by a friction fit in grooves in the rotor. The longitudinal seal portion includes an outwardly biased seal lip, and an elongated body portion fitting within the groove in the rotor. The elongated body portion has a pair of anchor elements connected by a flat arm element. The radial seal portion has an outwardly biased seal lip, and a retainer post securing the seal in a cavity in the rotor.

29 Claims, 5 Drawing Sheets

REPLACEABLE SEAL HAVING A FRICTION FIT

FIELD OF THE INVENTION

This invention relates to a replaceable seal, and more particularly, to a replaceable seal for a rotary fluid machine such as a pump or turbine.

BACKGROUND OF THE INVENTION

Rotary fluid machines, such as turbines or pumps, have been developed to measure the quantity of fluid that flows past a point, or inject predetermined quantities of liquid additives into liquid flow streams. Such devices can be used, for example, to add materials such as iodine or io: chlorine to drinking water or liquid fertilizer concentrate to irrigation water. They frequently employ one or two rotors or vanes that rotate in a housing or flow conduit. Turbines frequently employ rotors having close tolerances between the ends of the blades and the stator, while pumps frequently employ rotors with ends that engage the housing.

Most rotary fluid machines experience a degree of leakage during ordinary operation. This leakage increases as the rotors began to wear. Leakage generally occurs in both the radial and axial directions with respect to the rotors. Seals have been provided to minimize leakage, but are not completely effective.

It is important that the leakage in a pump or turbine be minimized. The head pressure that a pump or turbine can deliver is largely determined by the efficiency with which the leakage around the seals can be controlled. In addition, in certain applications, contamination of fluids being pumped or metered must be avoided.

When the leakage around the seals becomes significant, the seals must be replaced. This is a difficult task, particularly because it is generally not clear which seals are leaking, thus requiring some seals to be replaced that were not leaking.

SUMMARY OF THE INVENTION

In accord with the present invention, a seal for a rotor in a rotary fluid machine comprises a longitudinal seal portion secured in a longitudinal groove in the rotor by a friction fit, and a radial seal portion secured in a radial groove in the rotor by a friction fit. The longitudinal seal portion and the radial seal portion integrally form a unitary seal body.

In accord with another aspect of the present invention, a replaceable sealing system for a rotor in a rotary fluid machine comprises a pair of seals, each secured in radial and longitudinal grooves in the rotor. The seals have a unitary integrally formed body with a longitudinal seal portion and a radial seal portion. The longitudinal seal portion is dimensioned to make a secure friction fit in the longitudinal groove in the rotor, and the radial seal portion is dimensioned to make a secure friction fit in the radial groove in the rotor.

In accord with yet another aspect of the present invention, the improvement in a rotary fluid machine comprises a unitary replaceable seal with an integrally formed longitudinal seal portion secured by a friction fit in a longitudinal groove in the rotor, and an integrally formed radial seal portion secured by a friction fit in a radial groove in the rotor.

In accord with still a further aspect of the present invention, a replaceable seal for a rotor in a flow meter comprises a longitudinal seal portion secured by a friction fit in a longitudinal groove in the rotor. The longitudinal seal portion includes an outwardly biased seal lip, and an elongated body portion dimensioned to fit within the groove in the rotor and removably secure the seal in the rotor. The elongated body portion has a pair of anchor elements connected by a flat arm element. A radial seal portion is secured by a friction fit in a radial groove in the rotor, and has an outwardly biased seal lip. A retainer post is connected to the seal lip and is dimensioned to fit within a cavity in the rotor and removably secure the seal in the rotor. The retainer post is generally L-shaped, with a radial portion connected to the seal lip and mating with the radial groove in the rotor, and a longitudinal portion mating with a longitudinal bore in the rotor. The longitudinal seal portion and the radial seal portion integrally form a unitary seal body.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
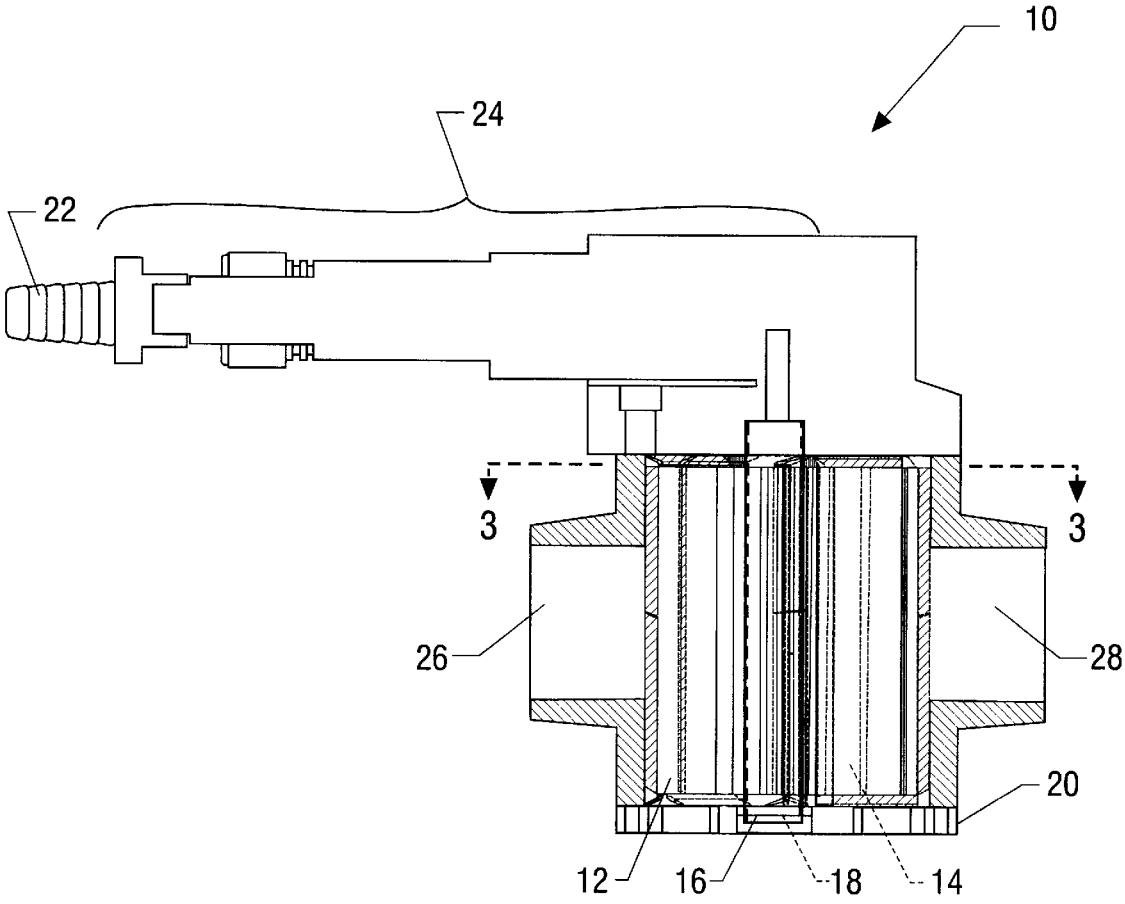
FIG. 1 is a cutaway plan view of a rotary fluid machine such as a meter showing the rotors with the seals of the present invention.

Referring to the drawings, and particularly to FIG. 1 thereof, there is shown a rotary fluid machine 10 such as a flow meter that includes a pair of rotors 12, 14 each rotatably mounted by a shaft 16, 18 in a housing 20. A suction fitting 22 supplies a vacuum to an injector 24. The rotors 12, 14 provide reciprocating motion to the injector 24 via the shafts 16, 18 through crankshafts connected to the shafts 16, 18. The reciprocating motion of the crankshafts 12, 14 injects materials, such as chlorine or iodine, into the fluid path and at or beyond an exhaust outlet 28. The rotation of rotors 12, 14 is provided by the flow of fluid through the housing 20. In the illustrated embodiment, fluid flows from the intake inlet 26, rotates the rotors 12, 14, and then flows out the exhaust outlet 28.

Figure 2:
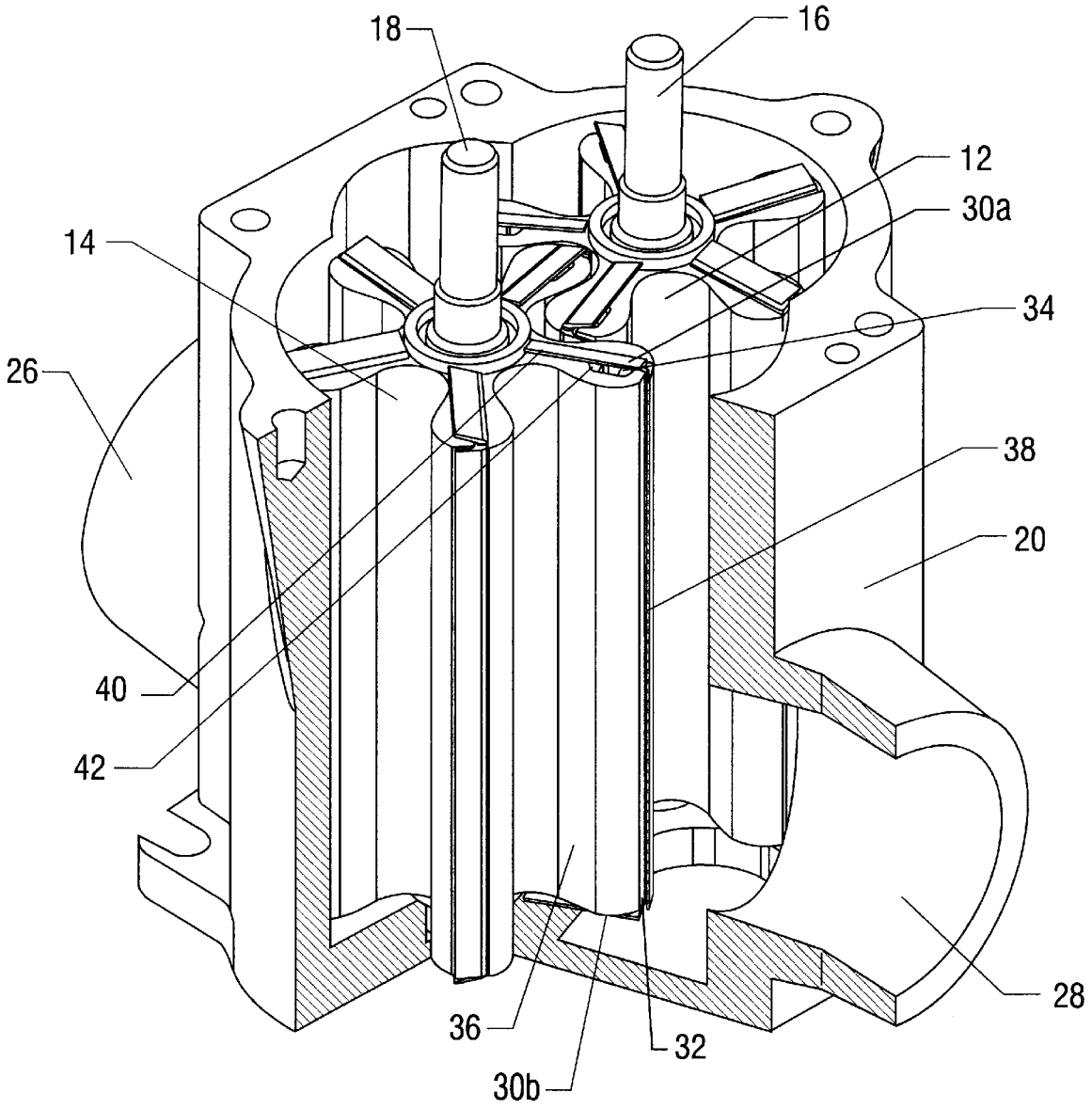
FIG. 2 is a cutaway perspective view of the rotary fluid machine of FIG. 1 illustrating the rotors and seals.

As seen in FIG. 2, each rotor 12, 14 includes a plurality of seals 30*a*, 30*b* positioned in corresponding interconnected longitudinal and radial grooves 32, 34 formed in the teeth or vanes 36 thereof. In the preferred embodiment, each seal 30*a*, 30*b* has a unitary integral body with a longitudinal portion 38 secured by a friction fit in the longitudinal groove 32 in the rotor 14 and a radial portion 40 disposed by a friction fit in the radial groove 34 in the rotor 14. Each longitudinal groove 32 has a pair of seals 30*a*, 30*b* disposed therein, with one seal 30*a* providing a sealing action along one radial edge of the rotor 14 and one half of the length of the longitudinal groove 32.

Figure 3:
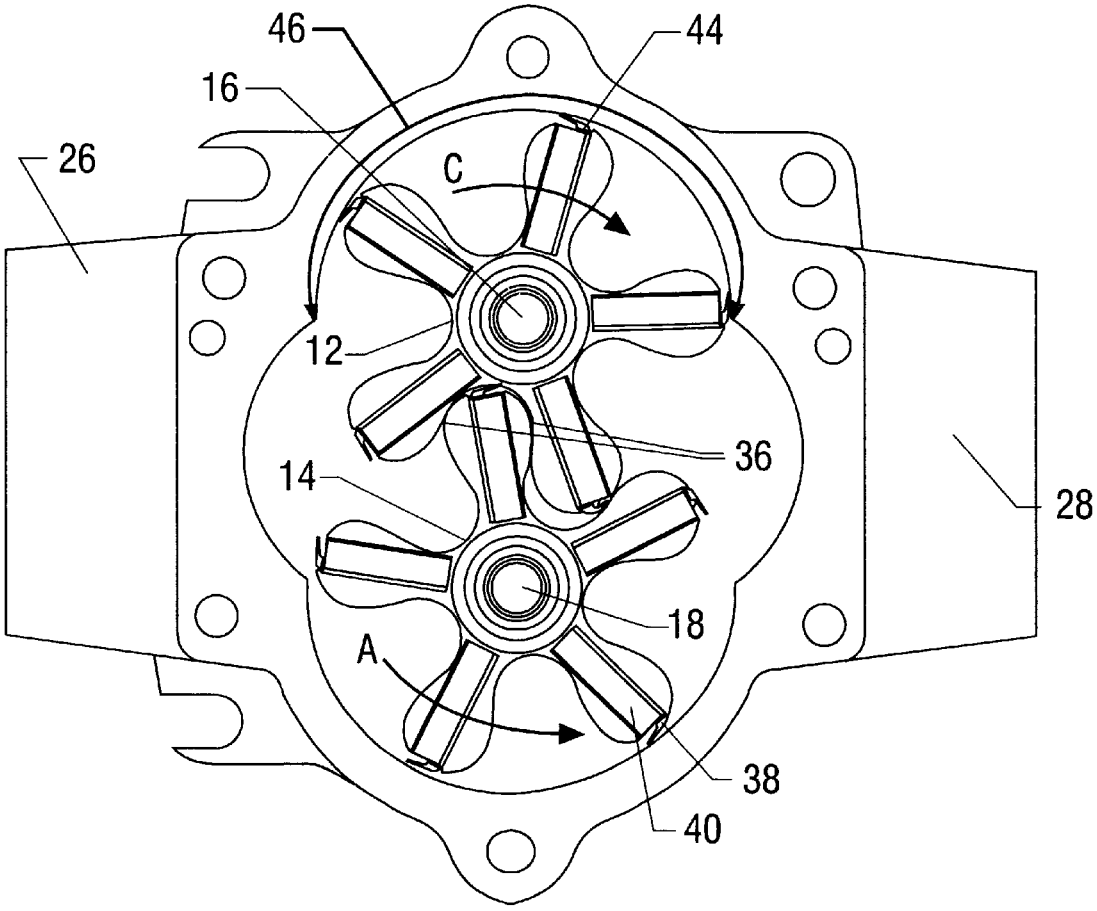
FIG. 3 is a fragmentary side view of the rotary fluid machine taken along the line 3—3 of FIG. 1.

As seen most clearly in FIG. 3, the rotors 12, 14 are mounted in the housing 20 with relatively close tolerances between the ends 44 of the vanes or teeth 36 and the housing 20. The depicted flow meter 10 has a pair of rotors 12, 14, each cooperating with the other and turning in opposite directions. The upper rotor 12 of FIG. 3 turns in the clockwise direction, as indicated by the arrow C, while the lower rotor 14 turns in the counterclockwise direction, as indicated by the arrow A.

In order to ensure adequate sealing between the rotors 12, 14 and the housing 20, it has been found that a minimum of two teeth or vanes 36, and corresponding four seals 30*a*, 30*b*, must be in contact with the housing 20 at one time. The seals 30*a*, 30*b* contact a portion of the housing 20 commonly identified as the sealing range 46.

Figure 4:
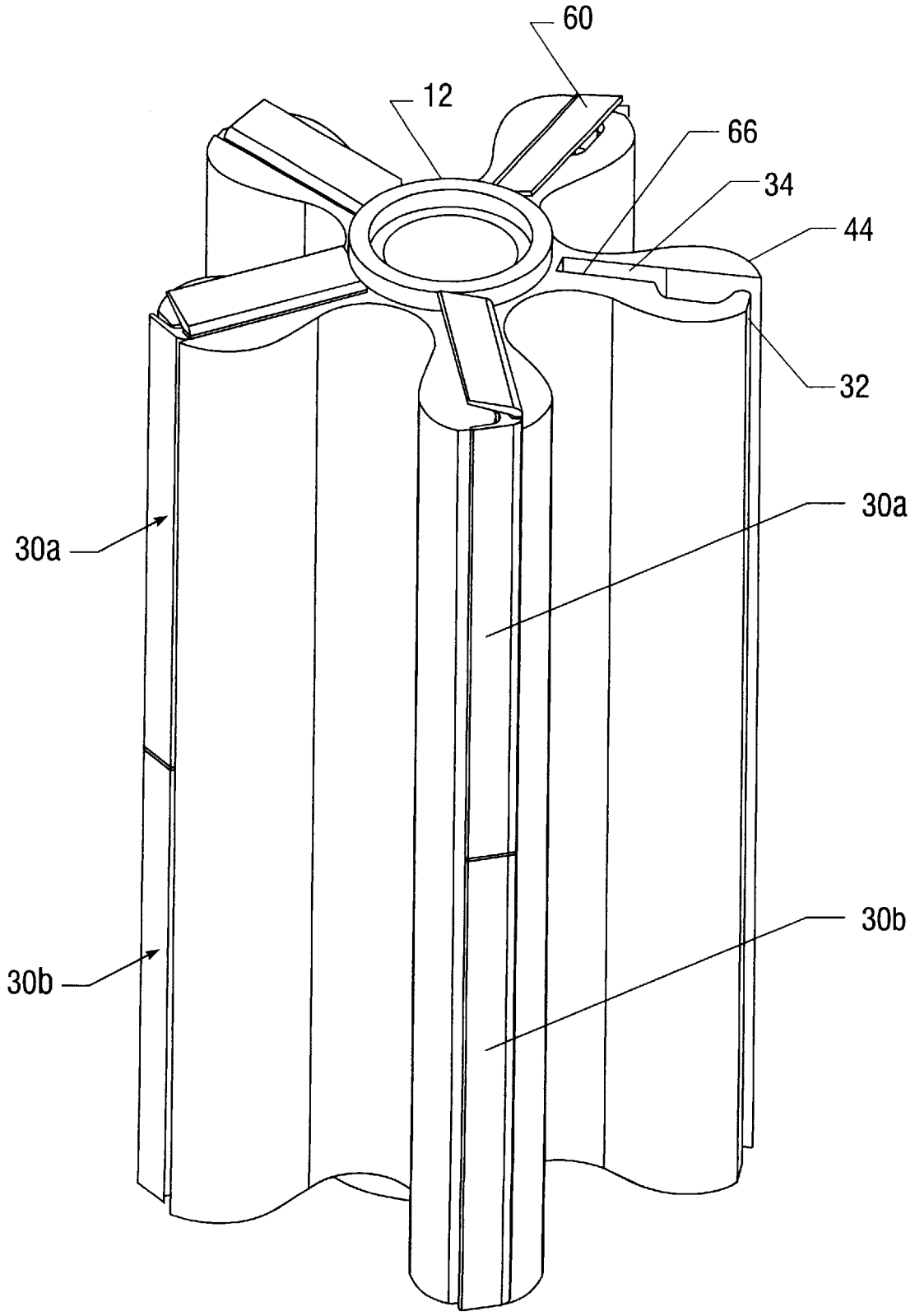
FIG. 4 is a perspective view of a rotor with one of the seals removed.
Figure 5:
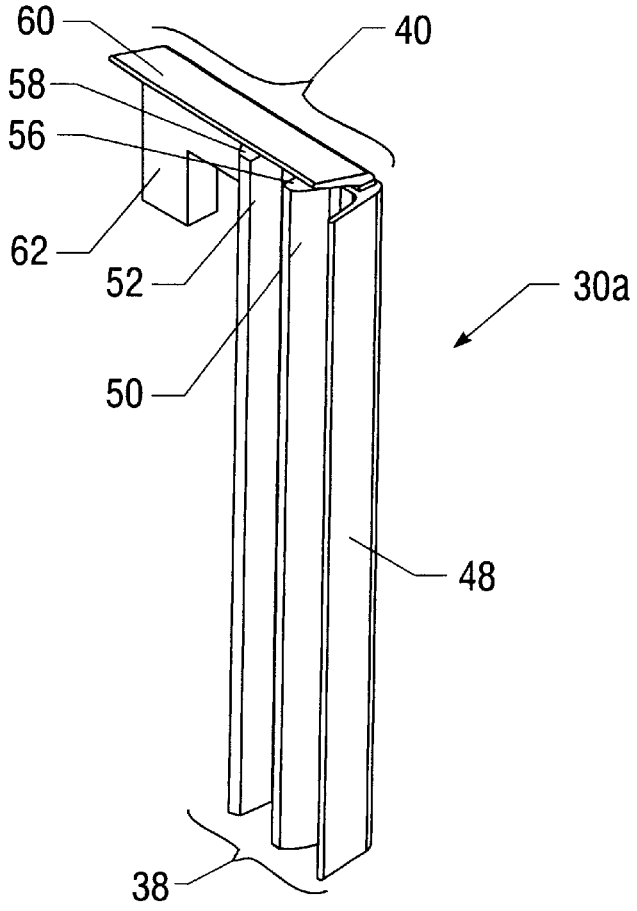
FIG. 5 is a perspective top view of a seal.
Figure 6:
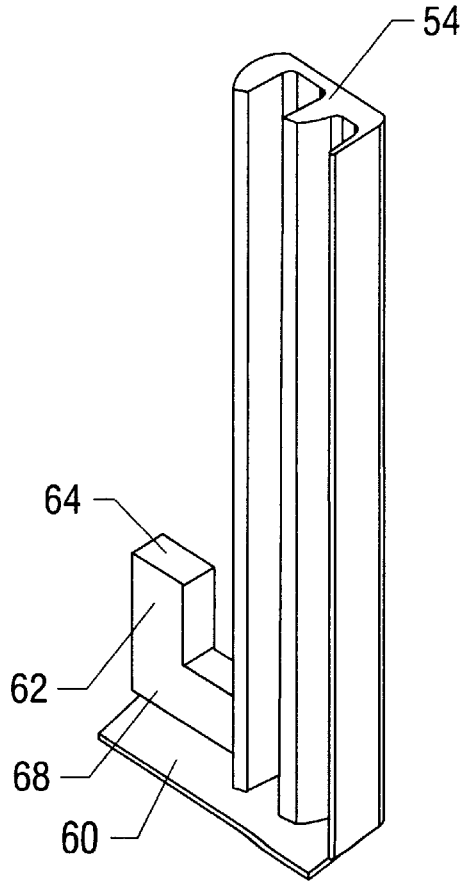
FIG. 6 is a perspective bottom view of the seal of FIG. 5.

As seen most clearly in FIGS. 5 and 6, each seal 30*a* is formed of a unitary integral body with the longitudinal seal portion 38 and the radial seal portion 40. The longitudinal seal portion 38 includes a flexible longitudinal seal lip 48 that is outwardly biased to contact the housing 20 (see FIGS. 2 through 4) and prevent leakage around the rotor 12 along the lateral edge thereof. The longitudinal seal portion 38 further includes a pair of anchor elements 50, 52 for anchoring or securing the seal 30*a* in the rotor 12. A flat arm element 54 connects the anchor elements 50, 52 (see FIG. 6).

The anchor elements 50, 52 are dimensioned so that the distal ends 56, 58 thereof act as stop elements for the biasing movement of a radial seal lip 60. When the seal 30*a* is disposed in the housing 20, the radial seal lip 60 (and horizontal seal lip 48 as well) are compressed to provide the requisite sealing action. The distal ends 56, 58 of the anchor elements 50, 52 prevent the radial seal lip 60 from moving too far inward (i.e., towards the inner portion of the rotor 12) and thereby damaging same.

The provision of a pair of anchor elements 50, 52 connected by a flat arm element 54 permits the longitudinal seal portion 38 to flex and form a good friction fit in the longitudinal 20 groove 32 of the rotor 12. This structure is advantageous because it maintains a close approximation of a constant wall thickness, thereby improving manufacturability due to the flow characteristics of the plastic used in the molding process. In addition, the flexibility of the longitudinal seal portion 38 allows for relatively lower tolerance standards to be applied to the shape of the longitudinal groove 32 of the rotor 12, since a tight fit can be obtained due to the flexing of the longitudinal seal portion 38. Finally, the disclosed structure is lighter in weight and less expensive to manufacture than a solid longitudinal seal portion 38 would otherwise be.

The seal 30*a* includes an L-shaped retainer post 62 to lock the seal 30*a* in the rotor 12. The radial seal portion 40 is a friction fit in the radial groove 42 of the rotor 12 and includes the outwardly biased radial seal lip 60 that mates with the housing 20 and prevents leakage therearound. The retainer post 62 includes a longitudinal portion 64 disposed in a longitudinal bore 66 in the rotor 12 (see FIG. 4). The longitudinal portion 64 of the retainer post 62 locks the seal 30*a* in the rotor 12 and prevents the seal 30*a* from being accidentally dislodged therefrom. A radial portion 68 is connected to the radial seal lip 60 and is friction fit into the radial groove 34.

It will be appreciated that the seals 30*a*, 30*b* of the present invention may be easily replaced in the rotor 12, 14. The old seal 30*a* is removed by applying a lateral force along the longitudinal seal portion 38, preferably by pulling on the radial seal portion 40. The anchor elements 50, 52 are then inserted in the longitudinal groove 32 of the rotor 12, and seal 30*a* slides in the longitudinal groove 32 until the radial seal portion 40 is press fit into the radial groove 34 of the rotor 12. The locking element 64 then locks the seal 30*a* in the rotor 12, 14, preventing accidental dislodgment.

It is to be further appreciated that, with an embodiment of the present invention, it is unnecessary to identify whether the longitudinal 38 seal or the radial 40 seal is causing the leakage, as both are replaced simultaneously.

For purposes of exemplification, particular embodiments of the invention have been shown and described according to the best present understanding thereof. However, it will be apparent that various changes and modifications in the arrangement and construction of the parts thereof may be made without departing from the spirit and scope of the invention as defined in the appended claims.

What is claimed is:

1. A seal for a rotor in a rotary fluid machine comprising:

a longitudinal seal portion secured in a longitudinal groove in said rotor by a friction fit;

a radial seal portion secured in a radial groove in said rotor by a friction fit;

wherein said longitudinal seal portion and said radial seal portion integrally form a unitary seal body.

2. The seal of claim 1, wherein said longitudinal seal portion includes an outwardly biased seal lip.

3. The seal of claim 2, wherein said radial seal portion includes an outwardly biased seal lip.

4. The seal of claim 3, wherein said longitudinal seal portion includes an elongated body portion dimensioned to fit within said groove in said rotor and removably secure said seal in said rotor.

5. The seal of claim 4, wherein said elongated body portion includes a stop element to limit the inward movement of said seal lip of said radial seal portion.

6. The seal of claim 5, wherein said elongated body portion comprises a pair of anchor elements connected by a flat arm element.

7. The seal of claim 6, wherein said radial seal portion includes a locking element connected to said seal lip and dimensioned to fit within a cavity in said rotor and removably secure said seal in said rotor.

8. The seal of claim 7, wherein said locking element comprises a retainer post.

9. The seal of claim 8, wherein said retainer post is generally L-shaped, with a radial portion connected to said seal lip and mating with said radial groove in said rotor, and a longitudinal portion mating with a longitudinal bore in said rotor.

10. A replaceable sealing system for a rotor in a rotary fluid machine, said rotor having a longitudinal groove connected to a radial groove on each end thereof comprising:

first and second seals removably secured in said grooves in said rotor, each of said seals having a unitary integrally formed body with a longitudinal seal portion and a radial seal portion, said longitudinal seal portion dimensioned to make a secure friction fit in said longitudinal groove in said rotor, and said radial seal portion dimensioned to make a secure friction fit in said radial groove in said rotor.

11. The sealing system of claim 10, wherein said longitudinal seal portion includes an outwardly biased seal lip.

12. The sealing system of claim 11, wherein said radial seal portion includes an outwardly biased seal lip.

13. The sealing system of claim 12, wherein said longitudinal seal portion includes an elongated body portion dimensioned to fit within said groove in said rotor and removably secure said seal in said rotor.

14. The sealing system of claim 13, wherein said elongated body portion includes a stop element to limit the inward movement of said seal lip of said radial seal portion.

15. The sealing system of claim 14, wherein said elongated body portion comprises a pair of anchor elements connected by a flat arm element.

16. The sealing system of claim 15, wherein said radial seal portion includes a locking portion dimensioned to fit within a cavity in said rotor and removably secure said seal in said rotor.

17. The sealing system of claim 16, wherein said locking portion comprises a retainer post.

18. The sealing system of claim 17, wherein said retainer post is generally L-shaped, with a radial portion connected to said seal lip and mating with said radial groove in said rotor, and a longitudinal portion mating with a longitudinal bore in said rotor.

19. In a rotary fluid machine with a rotor, the improvement comprising a unitary replaceable seal with an integrally formed longitudinal seal portion secured by a friction fit in a longitudinal groove in said rotor, and an integrally formed radial seal portion secured by a friction fit in a radial groove in said rotor.

20. The improvement of claim 19, wherein said longitudinal seal portion includes an outwardly biased seal lip.

21. The improvement of claim 20, wherein said radial seal portion includes an outwardly biased seal lip.

22. The improvement of claim 21, wherein said longitudinal seal portion includes an elongated body portion dimensioned to fit within said groove in said rotor and removably secure said seal in said rotor.

23. The improvement of claim 22, wherein said elongated body portion includes a stop element to limit the inward movement of said seal lip of said radial seal portion.

24. The improvement of claim 23, wherein said elongated body portion comprises a pair of anchor elements connected by a flat arm element.

25. The improvement of claim 24, wherein said radial seal portion includes a locking element connected to said seal lip and dimensioned to fit within a cavity in said rotor and removably secure said seal in said rotor.

26. The improvement of claim 25, wherein said locking element comprises a retainer post.

27. The improvement of claim 26, wherein said retainer post is generally L-shaped, with a radial portion connected to said seal lip and mating with said radial groove in said rotor, and a longitudinal portion mating with a longitudinal bore in said rotor.

28. A replaceable seal for a rotor in a flow meter comprising:

a longitudinal seal portion secured by a friction fit in a longitudinal groove in said rotor, said longitudinal seal portion including an outwardly biased seal lip, and an elongated body portion dimensioned to fit within said groove in said rotor and removably secure said seal in said rotor, said elongated body portion having a pair of anchor elements connected by a flat arm element;

a radial seal portion secured by a friction fit in a radial groove in said rotor, said radial seal portion including an outwardly biased seal lip, and a retainer post connected to said seal lip and dimensioned to fit within a cavity in said rotor and removably secure said seal in said rotor, said retainer post being generally L-shaped, with a radial portion connected to said seal lip and mating with said radial groove in said rotor, and a longitudinal portion mating with a longitudinal bore in said rotor;

wherein said longitudinal seal portion and said radial seal portion form a unitary seal body.

29. The replaceable seal of claim 28, wherein said elongated body portion includes a stop element to limit the inward movement of said seal lip of said radial seal portion.

* * * * *